US011814786B2

(12) United States Patent
Duncan et al.

(10) Patent No.: US 11,814,786 B2
(45) Date of Patent: Nov. 14, 2023

(54) TIE-DYE POPPERS AND METHOD FOR CREATING SAME

(71) Applicant: Paisley Crafts, LLC, Fresno, CA (US)

(72) Inventors: Chase Robert Hawk Duncan, Fresno, CA (US); Karen Mie Nishikawa, Clovis, CA (US)

(73) Assignee: Paisley Crafts, LLC, Fresno, CA (US)

( * ) Notice: Subject to any disclaimer, the term of this patent is extended or adjusted under 35 U.S.C. 154(b) by 42 days.

(21) Appl. No.: 17/714,749

(22) Filed: Apr. 6, 2022

(65) Prior Publication Data

US 2022/0325468 A1 Oct. 13, 2022

Related U.S. Application Data

(60) Provisional application No. 63/171,993, filed on Apr. 7, 2021.

(51) Int. Cl.

| | |
|---|---|
| ***D06P 1/00*** | (2006.01) |
| ***D06B 1/10*** | (2006.01) |
| ***D06P 1/44*** | (2006.01) |
| ***D06P 1/16*** | (2006.01) |
| *B28B 7/16* | (2006.01) |

(52) U.S. Cl.
CPC ..... *D06P 1/0096* (2013.01); *D06B 1/10* (2013.01); *D06P 1/16* (2013.01); *D06P 1/445* (2013.01); *B28B 7/168* (2013.01)

(58) Field of Classification Search
None
See application file for complete search history.

(56) References Cited

U.S. PATENT DOCUMENTS

| | | | | |
|---|---|---|---|---|
| 3,932,905 | A * | 1/1976 | Houben | D06B 1/10 26/96 |
| 6,739,779 | B1 * | 5/2004 | Deeds | B43K 8/03 222/137 |
| 8,182,712 | B1 * | 5/2012 | Maekawa | D06B 3/20 252/62.51 R |
| 2008/0282642 | A1 * | 11/2008 | Shah | B41M 7/0027 52/311.1 |
| 2010/0047531 | A1 * | 2/2010 | Baum | D06P 1/5221 427/256 |

* cited by examiner

*Primary Examiner* — Eisa B Elhilo
(74) *Attorney, Agent, or Firm* — Harness, Dickey & Pierce, P.L.C.; Stephen T. Olson

(57) ABSTRACT

A dispersion device configured to disperse a coloring material to a cloth substrate, comprising a hollow housing that contains the coloring material therein, the hollow housing being configured to fracture upon application of a force to the housing and disperse the coloring material to the cloth substrate to color the cloth substrate.

20 Claims, 7 Drawing Sheets

TIE-DYE POPPERS AND METHOD FOR CREATING SAME

CROSS-REFERENCE TO RELATED APPLICATIONS

This application claims the benefit of U.S. Provisional Application No. 63/171,993, filed on Apr. 7, 2021. The entire disclosure of the above application is incorporated herein by reference.

FIELD

The present disclosure relates to a device having a housing that contains a coloring material where the housing is configured to be broken to release the coloring material and a method of using the same.

BACKGROUND

This section provides background information related to the present disclosure which is not necessarily prior art.

Tie-dyeing is a process of dyeing an object, usually a garment, by hand. One or more portions of the garment are gathered together and then the gathered portions may be tied. After the garment has been prepared, dyes are applied, either by immersion of the garment into a dye bath or by applying dye directly to the garment. After the dye sets, the garment is untied and/or flattened, revealing the resulting dye pattern. In traditional tie-dyeing methods, the dye colors are known prior to the application of the dye, limiting the surprise of the dye pattern. Additionally, conventional tie-dyeing techniques only create patterns of certain types.

There remains a need for additional tie-dyeing techniques that allow additional types of patterns to be applied to garments, allowing for more varied creative expression. There also remains a need for a way to apply dye such that the user can be surprised by the color of the dye and without knowing the color beforehand.

SUMMARY

This section provides a general summary of the disclosure, and is not a comprehensive disclosure of its full scope or all of its features.

According to a first aspect of the present disclosure there is provided a dispersion device configured to disperse a coloring material to a cloth substrate. The dispersion device includes a hollow housing that contains the coloring material therein, wherein the hollow housing is configured to fracture upon application of a force to the housing and disperse the coloring material to the cloth substrate to color the cloth substrate.

According to the first aspect, the hollow housing may include a first section and a second section coupled together.

According to the first aspect, the first section may be coupled to the second section using an adhesive.

According to the first aspect, at least one of an exterior surface and an interior surface of the hollow housing may include a moisture-proof or moisture-resistant coating formed thereon.

According to the first aspect, the coloring material may be a dye-based coloring material or a pigment-based color material.

According to the first aspect, the coloring material may be a dye-based coloring material including a dye.

According to the first aspect, the dye-based coloring material may include a fixative material that is at least one of an alkali material, an acidic material, and a salt.

According to the first aspect, a ratio of the dye to the fixative material contained in the dye-based coloring material may be in a range of from about 0.1:1 to about 3:1

According to the first aspect, the hollow housing may be formed of plaster of paris.

The present disclosure also provides a kit that may include a plurality of the dispersion devices according to the first aspect, wherein the coloring material contained in each of the dispersion devices may be the same or different.

According to a second aspect of the present disclosure, there is provided a method for applying a coloring material to a cloth substrate. The method may include providing a dispersion device containing the coloring material, the dispersion device including a hollow housing that contains the coloring material therein, the hollow housing being configured to fracture upon application of a force to the housing; contacting the dispersion device with the cloth substrate; and applying the force to the hollow housing to fracture the housing and disperse the coloring material over the cloth substrate.

According to the second aspect, the method may also include pre-soaking the cloth substrate in water or a solution containing water before contacting the cloth substrate with the dispersion device.

According to the second aspect, the contacting the dispersion device with the cloth substrate may include wrapping the dispersion device with the cloth substrate.

According to the second aspect, the method may also include attaching a tying device to the cloth substrate at various locations of the cloth substrate to secure the dispersion device.

According to the second aspect, the cloth substrate may be a garment that contains at least one of natural fibers and synthetic fibers.

According to the second aspect, the coloring material may be a dye-based coloring material or a pigment-based color material.

According to the second aspect, the coloring material may be a dye-based coloring material including a dye.

According to the second aspect, the dye-based coloring material may include a fixative material that is at least one of an alkali material, an acidic material, and a salt.

According to the second aspect, the hollow housing may be formed of plaster of paris.

According to the second aspect, the hollow housing may include a first section and a second section coupled together.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
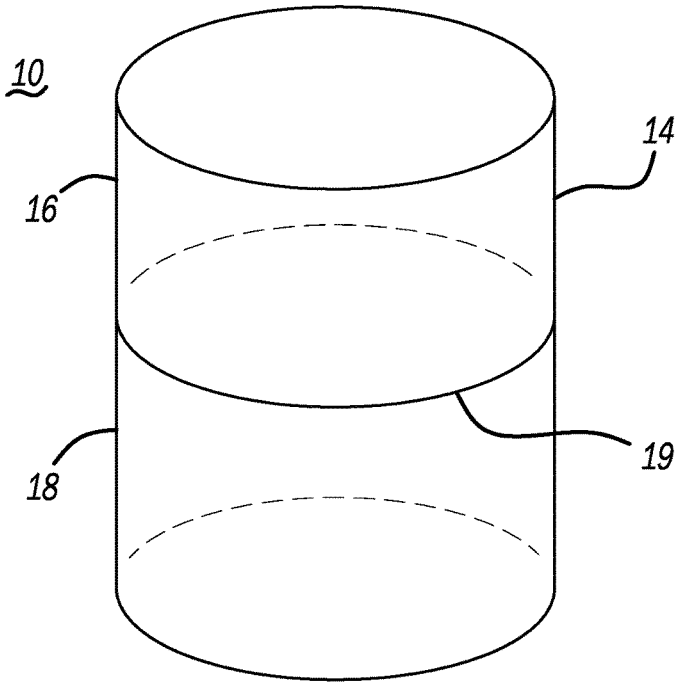
FIG. 1 is a perspective view of an example dispersion device according to a principle of the present disclosure.
Figure 2:
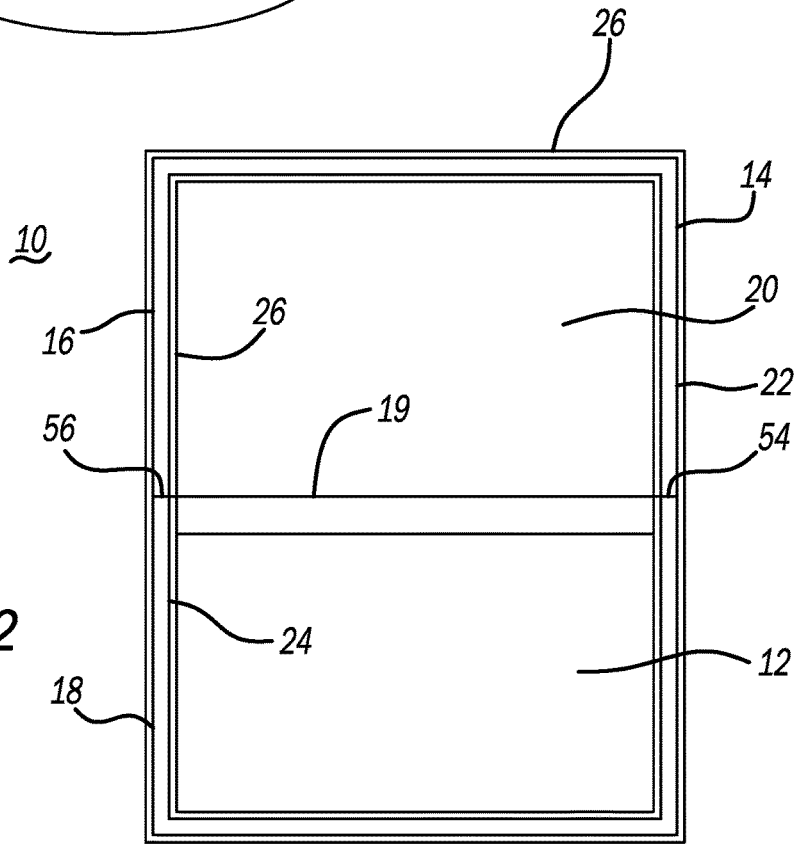
FIG. 2 is a cross-sectional view of the dispersion device illustrated in FIG. 1.

Various techniques are disclosed herein for coloring objects with patterns that are unable to be obtained by a conventional coloring method such as a tie-dyeing method. In particular, according to an aspect of the present disclosure and referring to FIGS. 1 and 2, the present disclosure provides a dispersion device 10 that may be used to disperse a coloring material 12 on the object to provide a decorative image on the object.

Dispersion device 10 includes a housing 14 that is configured to store the coloring material 12 therein. In accordance with the present disclosure, housing 14 is breakable such that upon application of a sufficient force to housing 14, the housing breaks and permits the coloring material 12 to be dispersed therefrom. Housing 14 includes a first section 16 and a second section 18 that are fixed to each other at 19, as will be described in more detail later. When first section 16 is coupled to second section 18, housing 14 is a hollow structure including a cavity 20 for storing coloring material 12. Alternatively, housing 14 may be a hollow structure including an aperture (not shown) that can be subsequently closed using a sealant (not shown) after housing 14 has been filled with the coloring material 12. While housing 14 is illustrated as being a cylindrical structure, it should be understood that other shapes are contemplated including spherical- or egg-shaped structures, square- or rectangular-shaped structures, or any other hollow shape desired.

Housing 14 includes an exterior surface 22 and an interior surface 24. Dependent on the type of coloring material 12 that is stored within housing 14, exterior and interior surfaces 22, 24 may include coating 26 formed thereon. Coatings 26 may be provided to assist in preventing or at least substantially minimizing moisture from penetrating housing 14 and/or for preventing or at least substantially minimizing the coloring material 12 from prematurely being released from housing 14.

For example, if coloring material 12 is a dry material, the coating 26 may only be provided to the exterior surface 22 and may be formed of a material that is moisture-proof or moisture-resistant. Coating 26 formed on exterior surface 22 prevents or at least substantially minimizes moisture from penetrating the shell 14 and reaching the dry coloring material 12, which may be moisture-activated as will be described in more detail later. Alternatively, if coloring material 12 includes an aqueous- or solvent-based vehicle (i.e., coloring material 12 is in the form of a liquid, gel, or paste), the coating 26 may be provided only on the interior surface 24 of housing 14, which prevents or at least substantially minimizes the water or solvent of the coloring material 12 from degrading the material of the housing 14 and permitting the coloring material 12 from prematurely escaping the housing 14 before housing 14 is broken to disperse the coloring material 12. It should be understood that in either case, housing 14 may simultaneously include coating 26 formed on each of the exterior and interior surfaces 22, 24 without departing from the scope of the present disclosure.

In an embodiment, the housing 14 may be made of a material such as plaster of paris (i.e., gypsum, or $CaSO_4 \cdot 2H_2O$). It should be understood, however, that other materials may be used to form housing 14 including, for example, corn syrup; wax; paper pulp; paper pulp combined with a polymer (e.g., polyvinyl acetate (PVA) glue, polyvinyl alcohol (PVOH) adhesive, cellulose, wax, or other polymers); paper pulp combined with a polymer and a material such as calcium carbonate ($CaCO_3$); paper pulp combined with a polymer, calcium carbonate, and cornstarch; paper pulp combined with flour and/or sugar; concrete without aggregate; mortar; mortar combined with paper pulp; cornstarch combined with a polymer (e.g., PVA glue); bioplastic; eco plastic (e.g., made with cornstarch and salt); modeling compound (e.g., made of flour, cornstarch, salt, and oil or other materials); paper or plastic tubing (e.g., where the coloring material 12 is put inside the tubing and then the ends thereof are sealed); hollow pasta with sealed ends; wood shavings/saw dust mixed with paper pulp and/or polymers; aluminum sheets (whole or diced) binded with paper pulp or other materials; rice cracker dough; and other materials known to one skilled in the art such as polymeric materials.

As noted above, housing 14 may include a coating 26 on at least one of the exterior surface 22 and interior surface 24. When coloring material 12 is a dry material, the coating 26 may be formed of a natural material such as beeswax, though other moisture-resistant materials may be used. For example, coating(s) 26 may be formed of a polyolefin material such as polyethylene or polypropylene, a thermoplastic resin material such as a (meth)acrylic resin, a polystyrene resin, a vinyl resin, a polytetrafluoroethylene (PTFE) resin, and the like. Alternatively, the material selected for housing 14 may comprise a material that in and of itself is moisture-resistant such as a polymeric material. If coloring material 12 includes an aqueous- or solvent-based vehicle, the material selected for coating(s) 26 may be selected from the materials listed above provided that the material is resistant to degradation through contact with the vehicle. That is, if the coloring material 12 includes a solvent-based vehicle, it would be appropriate to select a material for coating(s) 26 that will not dissolve when exposed to the solvent-based vehicle.

Coloring material 12 is a material that, when dispersed from dispersion device 10, is configured to color a substrate. According to the present disclosure, the substrate is preferably formed from a cloth material. The cloth material may be formed of natural fibers (e.g., cotton, wool, silk, linen, cellulose, and the like) or synthetic fibers (e.g., polyamide, polyester, acrylic fibers, and the like). While the cloth material is generally in the form of a garment or article of clothing, it should be understood that dispersion device 10 can be used to apply coloring material 12 to other cloth substrates that are in the form of sheets, wall coverings, drapes, carpets, furniture, or any other type of cloth substrate known to one skilled in the art, without limitation. In addition, while dispersion device 10 is preferably used to color a cloth substrate, other substrate materials can be used such as, for example, paper.

Coloring material 12 may be a dye-based coloring material, a pigment-based coloring material, or a combination thereof. If coloring material 12 is a dye-based color material, coloring material 12 may comprise at least one dye. The dye-based coloring material may also include at least one fixative (e.g., sodium bicarbonate). Inasmuch as each dispersion device 10 may include a single color (e.g., blue, red, green, yellow, orange, brown, black, and the like), the dye(s) selected for coloring material 12 will be determined based on the desired color. The dye-based coloring material may be at least one dye selected from a reactive dye; a fiber reactive dye; a hot-water fiber reactive dye; a heat-activated dye; a dichlorotriazine reactive dye; a monochlorotriazine reactive dye; and a vinyl sulfone.

If the dye-based coloring material includes at least one fixative, the fixative that can be used in the dye-based coloring material mixture may be selected from an alkali material, a salt, and/or an acid material. Alkalis include baking soda (i.e., sodium bicarbonate), soda ash, borax, potassium carbonate, trisodium phosphate, tetrasodium pyrophosphate, urea, sodium sesquicarbonate, and the like. Salts include sodium chloride, magnesium sulfate, sodium sulfate, and the like. An example acid includes citric acid, but other acids known to those skilled in the art are contemplated. Alkalis raise pH, and are useful for cellulose-based fibers. Acids lower pH, and are useful for protein-based fibers such as wool. Salts do not change pH, but promote dye exhaustion (i.e., transferring the dye to the fabric).

In an embodiment, the ratio of dye to fixative ranges from about 0.1:1 to about 3:1, which may depend on the color of the selected dye. If a salt is included in the mixture, the salt may comprise about 40% to about 50% of the total mixture by weight. Example compositions are shown in Table 1, below.

In addition, the dye-based coloring material may contain other types of dry materials, such as but not limited to other types of dyes, pigment, colorants, powders, confetti, glitters, and other materials that may change the appearance of the substrate. If a pigment-based coloring material is selected for use as coloring material 12, the coloring material 12 may include any pigment or combination of pigments known to one skilled in the art including inorganic pigments and organic pigments. Examples of inorganic pigments include carbon black, iron-based pigments such as iron oxides, titanium-based pigments such as titanium oxide, and others. Fluorescent pigments may also be used. Examples of organic pigments include azo pigments, polycyclic pigments, phthalocyanine pigments, and anthraquinone pigments.

If the coloring material 12 is pigment-based, the coloring material 12 preferably includes the pigment dispersed in a vehicle such as water, a solvent, or a combination thereof. If a solvent is used in combination with water, the solvent is preferably water-soluble. Example solvents include glycol ethers, alcohols or other polyols, nitrogen-based solvents, and the like. The pigment-based coloring material is generally in a liquid form, a gel form, or a less viscous paste. In addition to the vehicle, if the coloring material 12 is pigment-based, the coloring material 12 may include a polymeric material such as a (meth)acrylic resin or emulsion that assists with adhering the pigment to the substrate to be colored (e.g., a fabric).

Regardless whether a dye-based coloring material or a pigment-based coloring material is selected for use in a respective dispersion device 10, it should be understood that the color of the dye-based coloring material or the pigment-based coloring material may be indicated on the dispersion device 10. For example, the color of the coloring material 12 contained in the dispersion device 10 can be printed on the housing 14, a sticker indicating the color of the coloring material 12 may be adhered to the housing 14, or the material that forms the housing 14 can be colored to correspond to the color of the coloring material 12. If the housing 14 is colored, the material of the housing 14 may include the same respective dye, same respective pigment, or some other coloring material that corresponds to the color of the coloring material 12 contained within housing 14. Alternatively, the color of the color material contained in the dispersion device 10 may remain a mystery such that during use of the dispersion device, the resultant color applied to the substrate can be a surprise to the user.

Figure 3:
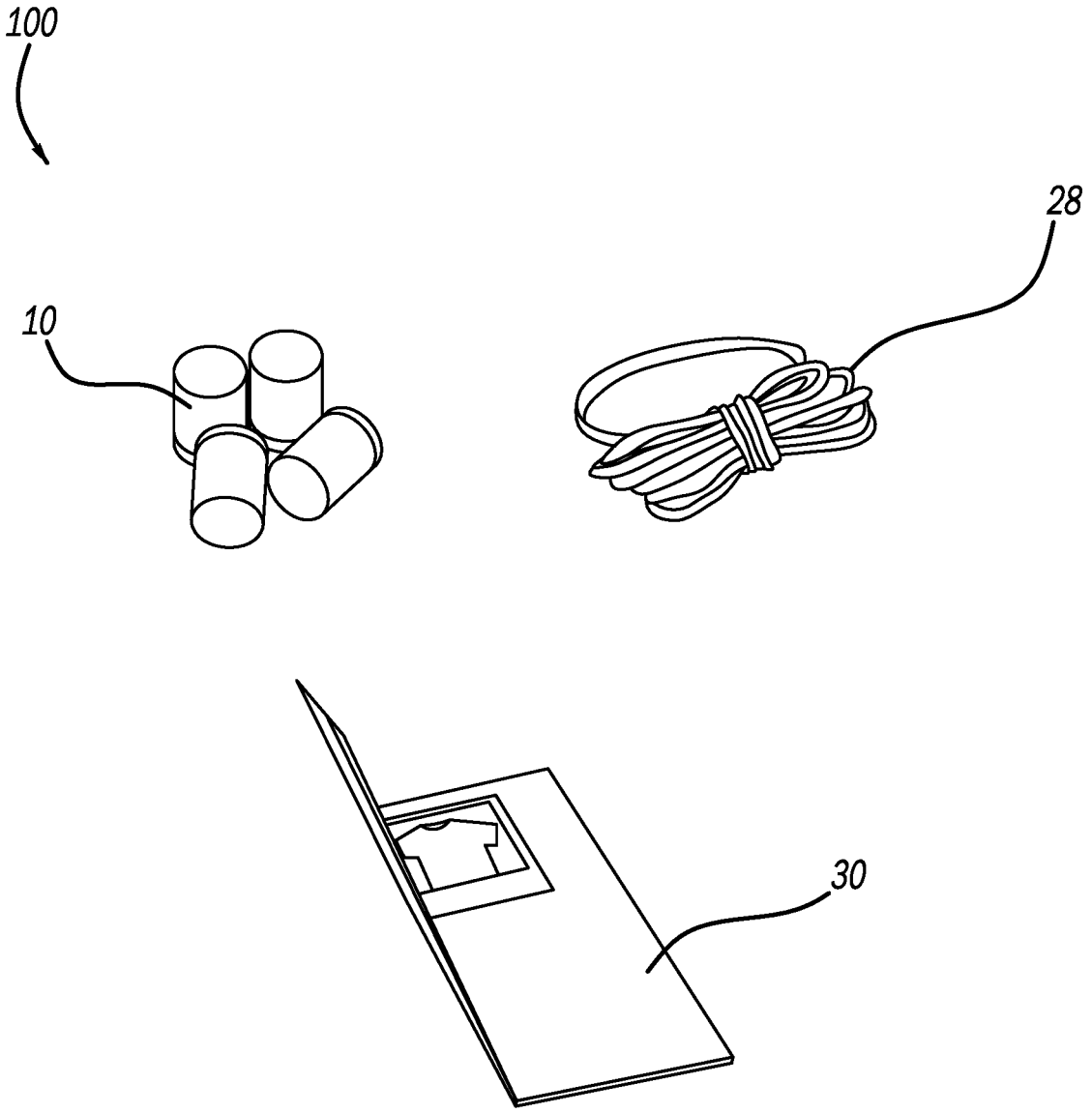
FIG. 3 is a perspective view of a kit that may include a plurality of the dispersion devices illustrated in FIGS. 1 and 2.

Now referring to FIG. 3 it can be seen that dispersion device 10 may be part of a kit 100 that includes a plurality of dispersion devices 10 that may each have the same or different coloring materials, an optional plurality of tying devices 28, and an instruction sheet or manual 30. Although not illustrated, the kit 100 may also contain a substrate to be colored such as a garment, a mallet or some other type of device that can be used to fracture the housing 14 to disperse the coloring material 12, and cleaning supplies. In most cases, however, the substrate to be colored will be provided by the user. Kit 100 may also include bag (not shown) that is configured for receipt of the substrate to be colored and the dispersion device(s) 10 that can be used to prevent the coloring material 12 from inadvertently coloring other objects located near the substrate when the housing 14 is broken to disperse the coloring material 12 located within housing 14. The bag, however, can be provided by the user or omitted.

The selected dispersion device(s) 10 and selected substrate to be colored (e.g., a garment) may be placed inside a bag prior to the housing 14 of the dispersion device(s) 10 being broken by the user. The bag, while optional, may assist in keeping the broken pieces of the housing 14 and the dispersed coloring material 12 contained. Alternatively, the substrate to be colored and the dispersion device(s) can be placed upon a sheet (e.g., a plastic sheet) or surface that is resistant to being colored.

The tying devices 28 may be any type of tying device known to one skilled in the art such as, for example, an elastic band (e.g., rubber band). Alternatively or in addition to, tying devices 28 may be in the form of plastic ties, clips, clamps, twine, tape, zip ties, staples, cotton yarn, nylon cording, sinew, and the like.

Instruction sheet or manual 30 may comprise one or more instructions for a user to perform a method for coloring the substrate. In this regard, the instruction sheet may include one or more techniques for coloring the substrate, instructions on the steps to take to disperse the coloring material 12 from the dispersion device(s) 10 (e.g., how to break the housing 14), include examples of how to use the tying devices 28 to arrange the substrate in various orientations to adjust a coloring pattern that may be formed on the substrate using dispersion device(s) 10, and examples showing the user how to obtain a particular coloring pattern. In addition, the manual 30 may include information on the specific materials that form dispersion device(s) 10 including, for example, the types of materials used to form housing 14 and coloring material 12.

Figure 4:
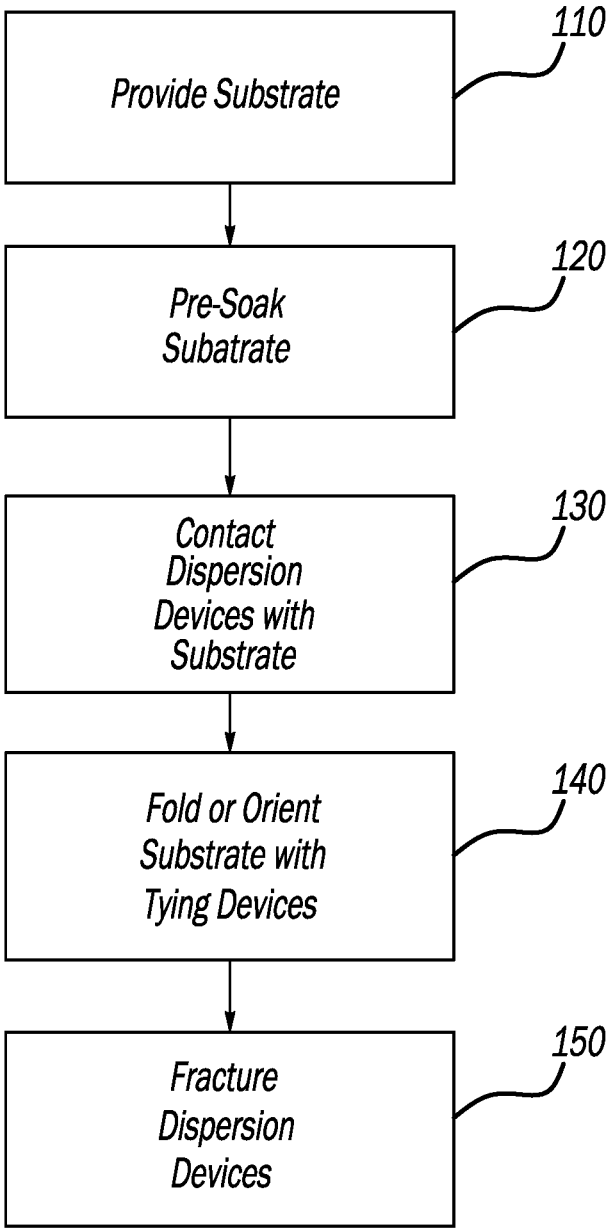
FIG. 4 illustrates a method of using the dispersion devices illustrated in FIGS. 1 and 2 to color a substrate.

Referring to FIG. 4, when the user is ready to color a substrate (e.g., a garment) (step 110), the user may first pre-soak the substrate in water or in a solution of water and soda ash (if necessary for adjustment of the pH, but other pH adjustment materials may also be used) for a period of time that is sufficient for the fibers of the substrate to become saturated (step 120). For example, a substrate that includes natural fibers such as cotton may be soaked for an amount of time that is about 1 minute, or greater.

After soaking the substrate, excess water or solution may be removed from the substrate. If the substrate is a garment, the excess water or solution may be removed by, for example, squeezing or wringing out the garment until the garment is only damp. Other methods for removing excess water or solution are contemplated including, without limitation, using an air dryer that blows air on the garment, or permitting the garment to be hung for a period of time sufficient to permit excess water or solution to drain from the garment. In any event, a less saturated substrate may result in sharper color patterns with, for example, more color speckles, whereas a more saturated garment may result in a softer, diffused color pattern.

The user may then contact the dispersion device(s) 10 with the substrate (step 130), and then gather sections of the substrate or fold one or more desired sections of the substrate together, and secure the gathered or folded sections using the tying devices 28 (step 140). This step may be omitted if the user prefers to apply the coloring material 12 of the dispersion device(s) 10 to a flat substrate. The user may also include dispersion device(s) 10 in the gathered sections or folds of the substrate during the gathering and folding process.

The substrate may then be placed inside a bag along with at least one of the dispersion devices 10 having a selected or mysterious (i.e., unknown) color. The dispersion device(s) 10 may be placed in contact the substrate, or as noted above tucked between the gathered sections or folds of the substrate. Alternatively, dispersion device(s) 10 can be added to the bag and the bag shaken to distribute the dispersion device(s) 10 randomly. The user may then partially seal the bag, which can allow air to escape during the process of breaking the dispersion device(s) 10.

Next, the user may use a mallet or similar device to strike the dispersion device(s) 10 with a force sufficient to fracture the housing 14 and disperse the coloring material 12 contained therein (step 150), which permits the coloring material 12 to contact and color the substrate. A period of time may elapse from the time the housing 14 fractures and the coloring material 12 is dispersed to permit the coloring material 12 to spread. The substrate being pre-soaked in water or solution may assist in the spreading of the coloring material 12 during this period of time. Another alternative is to shake the bag to further disperse the coloring material 12 over the substrate. Alternatively, the substrate may be immediately removed from the bag after fracturing the housing 14 and dispersing the coloring material 12.

In any event, after the housing 14 of the dispersion device(s) 10 has been broken, the substrate is retrieved from the bag, and the fractured pieces of housing 14 are gathered and discarded. For an instant design reveal, the substrate may be unfolded while shaking out the fractured pieces of housing 14. The freshly-colored substrate may then be spread out flat and permitted to dry. Alternatively, the colored substrate may be covered with, for example, plastic wrap to permit the coloring material 12 to set. The amount of time that the colored substrate is permitted to sit is variable, but in the case of coloring material 12 being a dye-based coloring material, the colored substrate may sit for a minimum of 4 hours to a maximum of 16 hours. The colored substrates may also remain undisturbed in the bag in which the dispersion device(s) 10 were broken during the setting time. After setting, the colored substrate can optionally be laundered.

In another embodiment, the colored substrate may be subjected to a heat source, such as a microwave, after the dispersion device(s) 10 have been broken. This process is described in U.S. patent application Ser. No. 17/019,143, entitled "METHOD AND KIT FOR TIE-DYEING," which is hereby incorporated by reference in its entirety. In such an embodiment, the dispersion device(s) 10 and the bag should be made from microwave-safe material.

Figure 5:
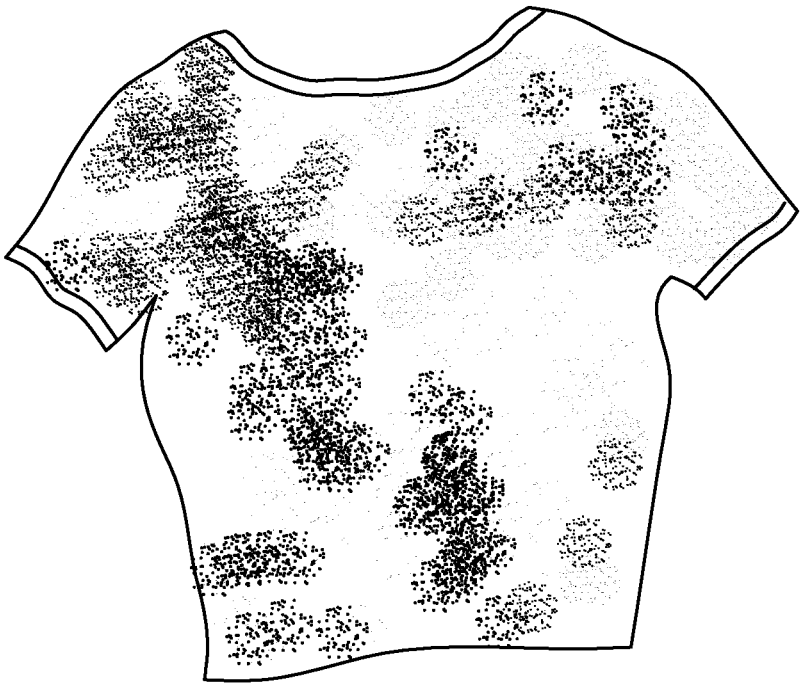
FIGS. 5 to 7 are images of various garment substrates that have been colored using a dispersion device according to the present disclosure.
Figure 6:
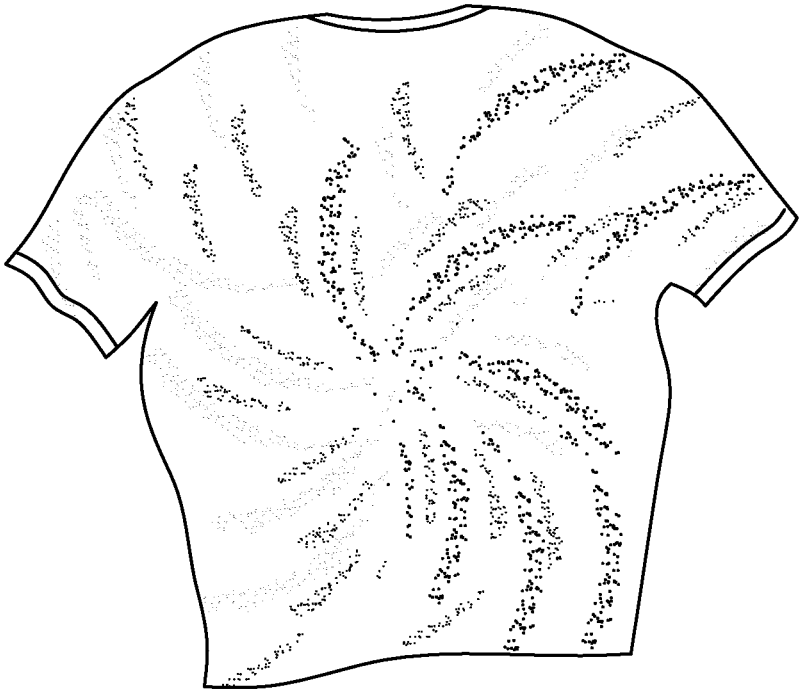
Figure 7:
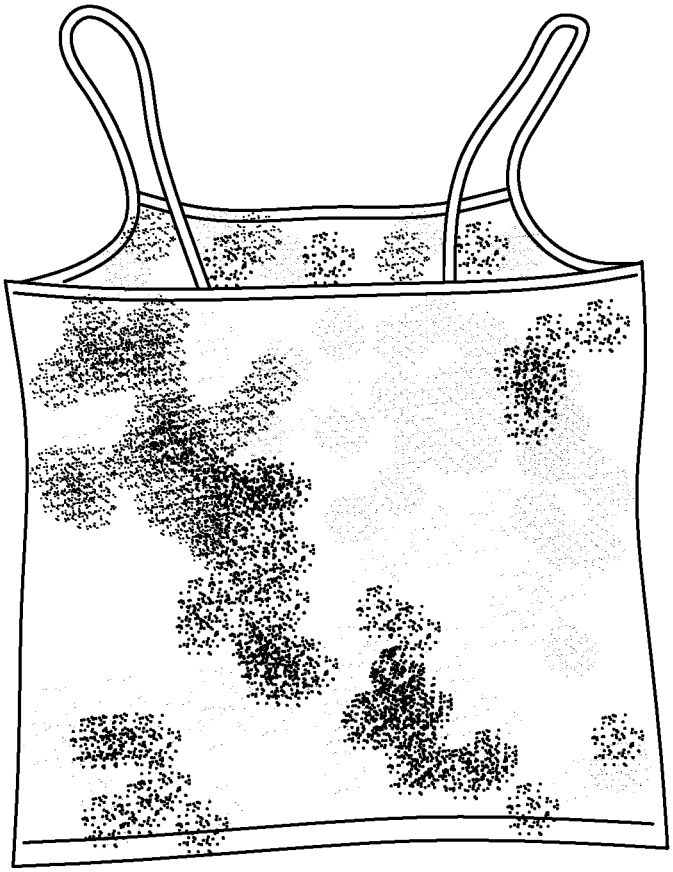

FIGS. 5 through 7 illustrate patterns that can be achieved using the dispersion device(s) 10. FIG. 5 is a children's shirt that has been crumpled and colored using the dispersion device(s) 10. FIG. 6 is an adult shirt that has been tied using a spider spiral technique and colored using the dispersion device(s) 10. FIG. 7 is a tank top that has been left flat (i.e., not placed in a bag with the dispersion device(s) 10) and colored using the dispersion device(s) 10.

Figure 8:
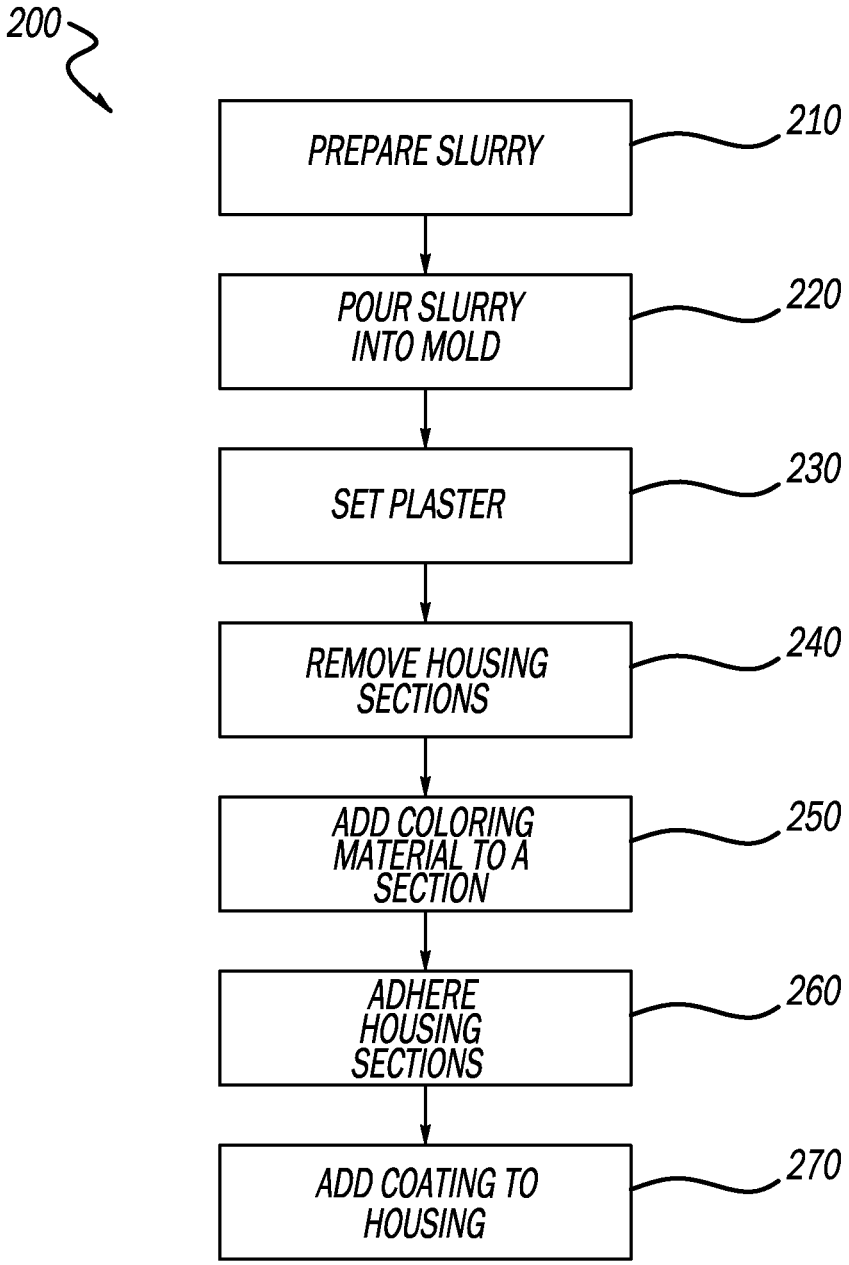
FIG. 8 illustrates an example method of manufacturing a dispersion device according to a principle of the present disclosure.

FIG. 8 illustrates a method 200 for forming dispersion devices 10. In a preferred embodiment, the dispersion devices 10 have a housing 14 made of plaster of paris (gypsum). Thus, the below-described method is directed to an example method that can be used to form housing 14 from plaster of paris. It should be understood, however, that this example method can be applied to forming housings 14 formed of some of the other materials described above.

In step 210, a plaster slurry is prepared by placing plaster powder in a mixing container and adding water slowly to the plaster while mixing by hand or by using a mixing device (e.g., a motor-powered mixer). Water should continue to be added until a smooth consistency is achieved. The ratio of powder to water may range from about 1:1 through about 1:1.3. The working time of the plaster slurry may range from about 5-8 minutes when mixing by hand, so preparing smaller batches is recommended. If a motor-powered mixer is used, the mixing time may be decreased or the batch size can be increased.

Figure 9:
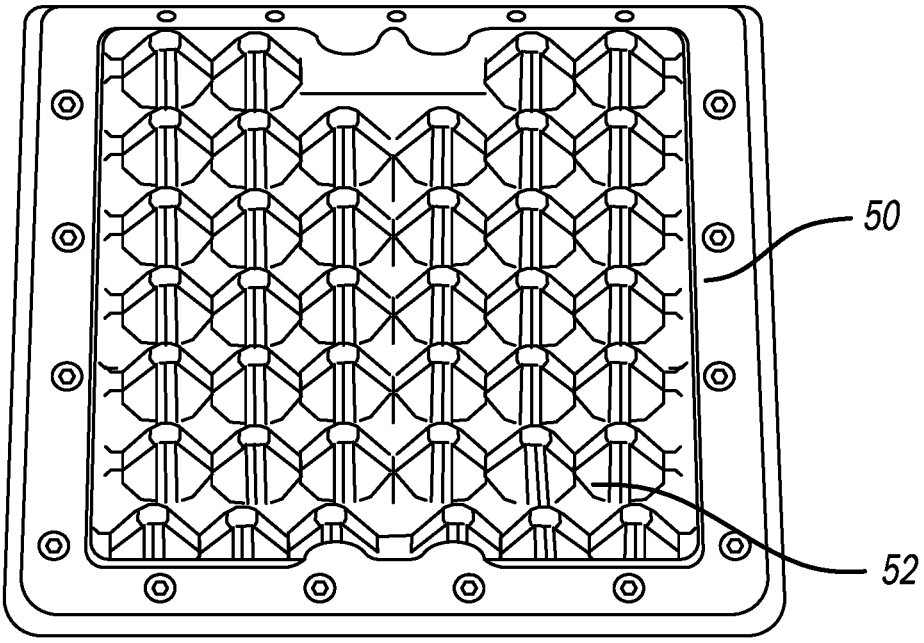
FIG. 9 is a perspective view of a mold that may be used in the method illustrated in FIG. 8.

After the slurry is prepared, it may be poured into a mold 50 in step 220. An example mold 50 is shown in FIG. 9, which may be formed of a flexible silicone material that resists the slurry from adhering to the mold 50 after being dried. If mold 50 is not formed of a silicone material, a lubricant (e.g., silicone lubricant or some other type of lubricant) can first be applied to the mold 50 to assist the slurry from adhering to the mold 50. In the illustrated embodiment, the mold 50 has a plurality of cavities 52 that can be used to form a plurality of housings 14. It should be understood that the mold 50 illustrated in FIG. 9 is not configured to form the entire housing 14, but rather form the first section 16 and second section 18 of housing 14 that may be subsequently joined together after coloring material 12 is added to one of the sections 16 or 18.

The mold 50 may be tilted back and forth to allow the plaster slurry to coat all sides of the cavities 52 to create a uniform housing 14 section 16, 18 thickness. In a preferred embodiment, a thickness of each section 16, 18 of the housing 14 is approximately 1.5 mm to approximately 2.5 mm, but the thickness is variable and may be dependent on the material(s) selected to create housing 14. In any event, the thickness of the sections 16, 18 of housing 14 should be selected to be rigid to an extent that permits easy handling and storage of dispersion devices 10 without fracturing the housing 14 before the desired time (i.e., at the time of coloring a substrate). While the thickness of housing 14 should be selected for easy handling and storage of the dispersion devices 10, the thickness should also be selected to ensure that force required to fracture housing 14 to disperse the coloring material 12 is not too great. That is, housing 14 should be able to fracture and disperse coloring material 12 without applying an excessive force.

In an embodiment of this method, half of the slurry may be poured into the mold 20, then the mold 50 and the remaining slurry may be put into a vacuum machine to remove air. Afterwards, the remaining slurry may be poured into the mold 20.

In step 230, the plaster is allowed to set until all moisture has evaporated. To shorten the drying process, the mold 50 containing the plaster may be placed in an oven and dried, or air may be blow over the plaster in the mold 50.

In step 240, the sections 16, 18 are removed from the molds 50, and imperfections in the exterior surface 22 of each section 16, 18 such as rough edges may be removed by, for example, using sandpaper or some other type of abrasive such as an abrasive cloth, emery board, other any other abrasive device known to one skilled in the art.

In step 250, coloring material 12 is added to one of the sections 16 or 18. In one embodiment, a dispersion device 10 may include an amount of coloring material 12 that ranges between about 1 gram and 1.4 grams. More particularly, about 1.2 grams may be used. The below Table 1 shows example compositions of various colors.

TABLE 1

| | % | grams/each popper |
|---|---|---|
| YELLOW | | |
| YELLOW (tie dye) | 51.415 | 0.6170 |
| SODIUM BICARBONATE | 48.584 | 0.5830 |
| total: | 100 | 1.2 |
| ORANGE | | |
| ORANGE (tie dye) | 67.04 | 0.8045 |
| SODIUM BICARBONATE | 32.96 | 0.3955 |
| total: | 100 | 1.2 |
| RED | | |
| RED (tie dye) | 67.507 | 0.8101 |
| SODIUM BICARBONATE | 32.492 | 0.3899 |
| total: | 100 | 1.2 |
| PURPLE | | |
| PURPLE (tie dye- blue shade) | 67.249 | 0.8070 |
| SODIUM BICARBONATE | 32.75 | 0.3930 |
| total: | 100 | 1.2 |
| BLACK (tie dye) | 65.494 | 0.7859 |
| SODIUM BICARBONATE | 34.505 | 0.4141 |
| total: | 100 | 1.2 |
| NAVY BLUE | | |
| NAVY (tie dye) | 68.062 | 0.8167 |
| SODIUM BICARBONATE | 31.938 | 0.3833 |
| total: | 100 | 1.2 |
| GREEN | | |
| GREEN (tie dye) | 60.761 | 0.7291 |
| SODIUM BICARBONATE | 39.238 | 0.4709 |
| total: | 100 | 1.2 |
| TURQUOISE | | |
| TURQUOISE (tie dye) | 31.117 | 0.3734 |
| SODIUM BICARBONATE | 25.847 | 0.3102 |
| SODIUM CHLORIDE | 43.036 | 0.5164 |
| total: | 100 | 1.2 |
| FUCHSIA | | |
| FUCHSIA (tie dye) | 47.979 | 0.5757 |
| SODIUM BICARBONATE | 52.02 | 0.6242 |
| total: | 100 | 1.2 |

It should be understood, however, that the volume of each dispersion device 10 can be variable and adjusted to include more or less coloring material 12, as desired. Moreover, it should be understood that before the coloring material 12 is added to one of the sections 16 or 18, a coating 26 (see, e.g., FIG. 1), if desired, may be applied to an interior surface 24 of the respective section 16, 18.

In step 260, an edge or lip 54 of an empty section 16 or 18 may be dipped in an adhesive 56 and attached to the other section 16 or 18 that contains the coloring material 12, to form a complete dispersion device. Adhesives 56 that may be used in this step include various glues, stearic acid, polyvinylpyrrolidone (PVP), polyvinyl alcohol (PVA), the same slurry material that the housing 14 is made of (i.e., as a glue), cyanoacrylates (super glues), craft flues (e.g., Alene's True Snow), and other adhesives known to one skilled in the art.

In one embodiment, wax may be used as the adhesive 56. In this embodiment, a wax having a melting point in the range of 135 degrees F. to 149 degrees F. is used because a low melting point wax having a melting point in the range of 75 degrees F. to 135 degrees F. may melt in transit or while the dispersion device 10 is in storage and a high melting point wax having a melting point in the range of 150 degrees F. to 165 degrees F. may be too brittle. In a particular embodiment, beeswax (melting point in the range of 144 degrees F. to 149 degrees F.) is used because it is devoid of water and provides a moisture-resistant seal—water will activate the dye if the coloring material 12 is a dye-based coloring material—and is eco-friendly. Other waxes including paraffin, slack wax, scale wax, microcrystalline wax, palm wax, soy wax, lanolin, carnauba wax, and the like, may also be used. In addition, these waxes may also be used as coating 26.

While the above process uses two sections 16, 18 that are substantially the same in dimensions, thickness, and the like to form housing 14, it should be understood that instead of using two sections 16, 18 that are substantially the same, a disc-shaped cap (not shown) formed of the same material (e.g., plaster of paris) may be attached to the section 16 or 18 that contains the coloring material 12 to complete the housing 14. If housing 14 includes an interior coating 26, the coating 26 should be applied before filing a section 16 or 18 with coloring material 12 and before coupling the sections 16, 18 together. A method for applying the interior coating 26 is described below, which may be the same as the method for applying the exterior coating 26.

In step 270, the housing 14 may be rolled or dipped in melted wax (such as the waxes listed above) or another moisture-resistant material to form coating 26 in the exterior surface 22 of housing 14. Alternatively, the material that forms coating 26 can be sprayed or dripped on the housing 14. As noted previously, coating 26 is configured to create a moisture-proof or moisture-resistant barrier that prevents or at least substantially minimizes moisture from reaching the coloring material 12 until the housing 14 is fractured to disperse the coloring material 12.

As noted above, a similar method can be used to create dispersion devices 10 from other materials, including paper pulp, paper pulp combined with a polymer, paper pulp combined with flour and/or sugar, paper pulp/calcium carbonate/polymer mixture, paper pulp/calcium carbonate/polymer/cornstarch mixture, mortar, mortar combined with paper pulp, cornstarch combined with a polymer, bioplastic, eco plastic, modeling compound (e.g., Play-Doh), wood shavings/saw dust combined with paper pulp and/or polymers, and aluminum sheets (whole or diced) binded with paper pulp or other materials. Each of these materials can be molded in a similar manner to create the sections 16, 18 that form the housing 14. If shell 14 is polymeric (e.g., thermoplastic), shell 14 can be blow-molded, injection molded, or compression molded.

In the embodiments using paper pulp, a paper with a relatively low tensile strength may provide the housing 14 with better shatter performance.

If the housing 14 is made of a material besides those listed above, other manufacturing techniques may be necessary. For example, if the housing 14 is made of corn syrup or wax, the coloring material 12 may be hardened by tumbling, and then the housing 14 may be applied with a panning machine.

Another alternative is a solid dispersion device 10. In an example embodiment of a solid dispersion device, salt, dye, water, and a thickening agent (e.g., a gelled attapulgite clay or another attapulgite product) in various ratios may be mixed together, then molded into a sphere, cube, or other shape and allowed to dry. Possible mixtures include: 5 g thickener, 10 g water, 30 g salt, and 3 g dye; 2 g thickener, 5 g water, 30 g salt, and 3 g dye; and 10 g thickener, 17 g water, 15 g salt, and 3 g dye.

Another alternative for a dispersion device 10 is molding a dough, such as rice cracker dough (made from cooked rice and oil), dough from potato starch, and the like around the dry dye-based coloring material and baking in an oven.

The disclosed dye poppers provide additional options for the tie-dyeing of garments and other objects. Tie-dye patterns that are difficult to create using conventional methods may be produced using the disclosed poppers. Furthermore, breaking the poppers provides a fun activity that can enhance the tie-dyeing experience.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A dispersion device configured to disperse a coloring material to a cloth substrate, comprising a hollow housing that contains the coloring material therein, the hollow housing being configured to fracture upon application of a force to the housing and disperse the coloring material to the cloth substrate to color the cloth substrate.

2. The dispersion device according to claim 1, wherein the hollow housing includes a first section and a second section coupled together.

3. The dispersion device according to claim 2, wherein the first section is coupled to the second section using an adhesive.

4. The dispersion device according to claim 1, wherein at least one of an exterior surface and an interior surface of the hollow housing includes a moisture-proof or moisture-resistant coating formed thereon.

5. The dispersion device according to claim 1, wherein the coloring material is a dye-based coloring material or a pigment-based color material.

6. The dispersion device according to claim 5, wherein the coloring material is a dye-based coloring material including a dye.

7. The dispersion device according to claim 6, wherein the dye-based coloring material includes a fixative material that is at least one of an alkali material, an acidic material, and a salt.

8. The dispersion device according to 7, wherein a ratio of the dye to the fixative material contained in the dye-based coloring material is in a range from about 0.1:1 to about 3:1.

9. The dispersion device according to claim 1, wherein the hollow housing is formed of plaster of paris.

10. A kit including a plurality of the dispersion devices according to claim 1, wherein the coloring material contained in each of the dispersion devices is the same or different.

11. A method for applying a coloring material to a cloth substrate, comprising:

providing a dispersion device containing the coloring material, the dispersion device including a hollow housing that contains the coloring material therein, the hollow housing being configured to fracture upon application of a force to the housing;

contacting the dispersion device with the cloth substrate;

applying the force to the hollow housing to fracture the housing and disperse the coloring material over the cloth substrate.

12. The method according to claim 11, further comprising pre-soaking the cloth substrate in water or a solution containing water before contacting the cloth substrate with the dispersion device.

13. The method according to claim 11, wherein the contacting the dispersion device with the cloth substrate includes wrapping the dispersion device with the cloth substrate.

14. The method according to claim 13, further comprising attaching a tying device to the cloth substrate at various locations of the cloth substrate to secure the dispersion device.

15. The method according to claim 11, wherein the cloth substrate is a garment that contains at least one of natural fibers and synthetic fibers.

16. The method according to claim 11, wherein the coloring material is a dye-based coloring material or a pigment-based color material.

17. The method according to claim 16, wherein the coloring material is a dye-based coloring material including a dye.

18. The method according to claim 17, wherein the dye-based coloring material includes a fixative material that is at least one of an alkali material, an acidic material, and a salt.

19. The method according to claim 11, wherein the hollow housing is formed of plaster of paris.

20. The method according to claim 11, wherein the hollow housing includes a first section and a second section coupled together.

* * * * *